United States Patent [19]

Takehisa et al.

[11] Patent Number: 4,949,775

[45] **Date of Patent: * Aug. 21, 1990**

[54] DIE CASTING ARRANGEMENTS

[75] Inventors: Fumitaka Takehisa, Anjo; Mitsuyoshi Yokoi, Takahama; Fumio Kondoh, Nagoya, all of Japan

[73] Assignee: Nippondenso Co., Ltd., Kariya, Japan

[ * ] Notice: The portion of the term of this patent subsequent to Aug. 9, 2005 has been disclaimed.

[21] Appl. No.: 404,070

[22] Filed: Sep. 7, 1989

Related U.S. Application Data

[60] Continuation of Ser. No. 310,002, Feb. 8, 1989, abandoned, which is a continuation of Ser. No. 178,316, Apr. 6, 1988, abandoned, which is a division of Ser. No. 947,207, Dec. 29, 1986, Pat. No. 4,762,163.

[30] Foreign Application Priority Data

Dec. 27, 1985 [JP] Japan ..... 60-298396

[51] Int. Cl.[5] ..... B22D 17/10; B22C 3/00

[52] U.S. Cl. ..... 164/267; 164/312

[58] Field of Search ..... 164/72, 74, 267, 312, 164/113

[56] References Cited

U.S. PATENT DOCUMENTS 4,562,875 1/1986 Ogoshi et al. ..... 164/267

FOREIGN PATENT DOCUMENTS 3518635 11/1985 Fed. Rep. of Germany ..... 164/312

1049178 10/1983 U.S.S.R. ..... 164/267

*Primary Examiner*—Kuang Y. Lin

*Attorney, Agent, or Firm*—Cushman, Darby & Cushman

[57] ABSTRACT

A die-casting arrangement which prevents a lubricant from becoming mixed into a die cast article which might cause it to bulge when later heated. The lubricating agent is sprayed over a high-temperature portion of a sprue interconnecting a mold cavity and an injection sleeve in order to partly carbonize the lubricant. The carbonized lubricating agent even if mixed into a die cast article will not expand even when the article is heated thereby preventing bulging of the article.

9 Claims, 4 Drawing Sheets

DIE CASTING ARRANGEMENTS

This is a continuation of Application Ser. No. 310,002, filed Feb. 8, 1989, now abandoned, which in tern is a continuation of application Ser. No. 07/178,316, filed Apr. 6, 1988, now abandoned, which in turn is a continuation of application Ser. No. 06/947,207, filed Dec. 29, 1986, now U.S. Pat. No. 4,762,163.

BACKGROUND OF THE INVENTION

1. Field of the Invention

The present invention relates to a diecasting arrangement (method and apparatus) which is particularly useful for die-casting of aluminum alloy.

2. Description of Prior Art

In a prior art die-casting method, stationary and movable molds are parted from each other. A lubricant is then applied over a mold cavity surface, after which the stationary and movable molds are brought into contact with each other to form a mold cavity. Then molten metal is poured into an injection sleeve communicating with the mold cavity, and an injection plunger slidable in the injection sleeve is moved forward to inject molten metal from the injection sleeve into the mold cavity at high speed. Thereafter, the molten metal injected into the mold cavity solidifies during the lapse of a predetermined period of time. The resulting solidified article is ejected from the mold cavity by an ejector pin which is extended into the mold to force out the article.

However, this prior art die-casting method has functional problems. The lubricant applied to the movable and stationary molds becomes mixed with the molten metal while the molten metal is being injected into the mold cavity. Since the lubricant assumes a liquid or gaseous form during this mixing, the lubricant mixed in the molten metal may expand when the solidified article is later heated during use, thus causing the article to bulge.

SUMMARY OF THE INVENTION

It is therefore an object of the present invention to prevent the solidified article from having any bulge due to the mixing of the lubricant with the molten material forming the article and the subsequent expansion of the lubricant.

In a first die casting method according to the invention a lubricant is sprayed over a high-temperature portion formed in a sprue interconnecting a mold cavity and an injection sleeve. Then movable and stationary molds are brought into contact with each other to form the mold cavity. Molten metal is then injected into the mold cavity.

The invention also provides a second die casting method wherein the stationary molds are first brought into contact with each other to form a mold cavity. After the cavity is formed, a lubricating agent is sprayed over a high-temperature portion formed in a sprue interconnecting the mold cavity, whereupon molten metal is injected into the mold cavity.

The invention also provides die-casting apparatus. This die casting apparatus includes: a stationary mold; a movable mold contactable with said stationary mold to define therewith a mold cavity; an injection sleeve opening at one end to said mold cavity for introducing molten metal into said mold cavity; an injection plunger slidably disposed within said injection sleeve for injecting said molten metal into said mold cavity; and a nozzle for spraying a lubricating agent over a high-temperature portion formed in a sprue interconnecting said injection sleeve and said mold cavity.

DETAILED DESCRIPTION OF THE PREFERRED EMBODIMENTS

Figure 1:
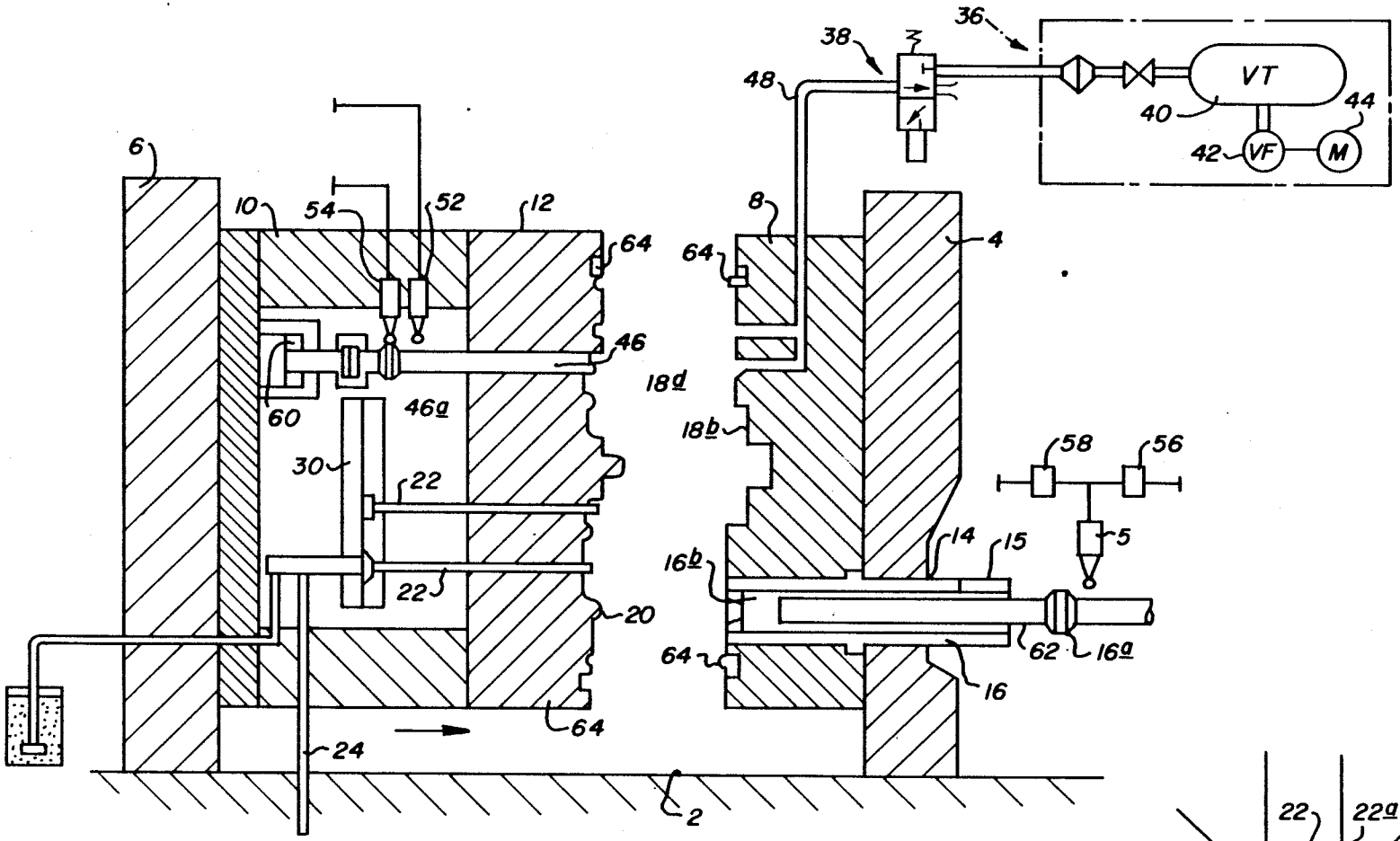
FIG. 1 is a cross-sectional view showing an apparatus according to the present invention.

The die casting apparatus according to the invention includes a stationary base 2 which may be attached to a floor of a factory. A stationary platen 4 is fixedly mounted on the stationary base 2. A movable platen 6 is located at a position opposed to the stationary platen 4. The movable platen 6 and the stationary platen 4 are interconnected by a tie-bar (not shown) in such a manner that the movable platen 6 is slidable toward and away from the stationary platen 4.

A stationary mold 8 on which a mold surface **18*b* is engraved is fixedly secured to the stationary platen 4. The stationary platen 4 and the stationary mold 8 are provided with an injection sleeve 14 extending therethrough. The injection sleeve 14 is in the form of a cylindrical tube, within which an injection plunger 16 is slidably disposed. The injection sleeve 14 is provided with a gate 15 through which molten metal can be poured into the injection sleeve 14. The injection plunger 16 has an increased diameter portion 16*a*. A die base 10 is fixedly secured to the movable platen 6, and a movable mold 12 is fixedly secured to the die base 10. The movable mold 12 also has a mold surface 18*a* engraved thereon. A mold cavity is defined by the mold surfaces 18*a*, 18*b* when the movable mold 12 and the stationary mold 8 are brought together. The mold cavity communicates with the interior of the injection sleeve 14**.

A negative pressure passageway 48 is formed in the stationary mold 8 communicating with the mold cavity defined by the mold surfaces **18*a*, 18*b*. The negative pressure passageway 48 communicates with a negative pressure source 36 via a valve 38. The negative pressure source 36 comprises a vacuum tank 40, a vacuum pump 42, and a motor 44 for driving the vacuum pump 42. The valve 38 is preferably an electromagnetic valve for switching the negative pressure 48 between a position in which it communicates with the negative pressure source 36**, and a position in which it opens to the atmosphere.

A cut-off pin 46 is disposed on the movable mold 12. The cut-off pin 46 is mounted on the movable mold 12 so as to extend therethrough, and is connected at one end thereof to a drive mechanism 60 for driving the cut-off in 46 and faces at the other end thereof to the negative pressure passageway 48. With the movable mold 12 contacting the stationary mold 8, the intercommunication between the negative pressure passageway 48 and the mold cavity can be shut off as the cut-off pin 46 is moved forward. The cut-off pin 46 has an increased diameter portion 46a. The position of the cut-off pin 46 is detected when the portion 46a hits an advanced-position limit switch 52 and a retracted-position limit switch 54, which are individually mounted on the die base 10. The drive mechanism 60 for the cut-off pin 46 is preferably a hydraulic mechanism.

The movable mold 12 is also provided with a plurality of ejector pins 22 for ejecting a solidified article resulting from solidification of the molten metal material in the mold cavity. Each of the ejector pins 22 communicates at one end thereof with an ejector plate 30 and faces at the other end thereof to the mold cavity. Of the ejector pins 22, a pin located adjacent to a sprue core 20 has an interior passageway therein for jetting a lubricant therethrough. The pin 22 with the lubricant jetting passageway communicates with a compressed air source (not shown) via an air passageway 24 and also with a lubricant reservoir 28 via a lubricant passageway 26. Accordingly, as the compressed air is jetted from the air passageway 24, the lubricant in the reservoir 28 is pumped up from the passageway 26 by the atomization phenomenon and is jetted, together with the compressed air, through the lubricant passageway of the ejector pin 22 toward the sprue core 20.

The sprue core 20 is formed on the movable mold 12 at a position confronting the injection sleeve 14. Usually, the movable and stationary molds 12, 8 are provided with cooling passageways (not shown) through which cooling water is circulated to cool the movable and stationary molds 12, 8. The temperature of the sprue core 20 is maintained very high (390°–420° C.) by regulating a cycle time of the die casting process and the amount of the cooling water circulated. The lubricant jetting passageway of the ejector pin 22 opens toward the sprue core 20 which is high in temperature.

The position of the injection plunger 16 can be detected when portion 16a hits a limit switch 5, to which an intermediate-stop-position timer 56 and a pump-up timer 58 are electrically connected. A lubricant introduction pipe 62 is located at the under surface of the injection plunger 16 for introducing a lubricant. The lubricant is introduced into the injection sleeve 14 to lubricate a chip 16b of injection plunger 16 for reducing the friction between the inside wall of the injection sleeve 14 and the chip end 16b of the injection plunger 16. The position to which this chip lubricant introduction pipe opens is such that it is near the front edge of the gate 15 when the injection plunger 16 is moved forward all the way as shown in FIG. 1.

The intermediate stop position timer 56 measures the time when the injection plunger 16 stops at the intermediate position. The pump-up timer 58 measures a time period during which the injection plunger 16 is stopped at the intermediate position. When the plunger 16 is stopped, switch 38 is switched so as to cause the cavity to be evacuated to form a negative pressure therein. After timer 58 times out a predetermined time value 38 switches again and pin 46 closes negative pressure passageway 48 which maintains a negative pressure in the cavity.

A sealing member 64 seals the stationary and movable molds 8, 12 when they are in contact with each other.

Figure 2:
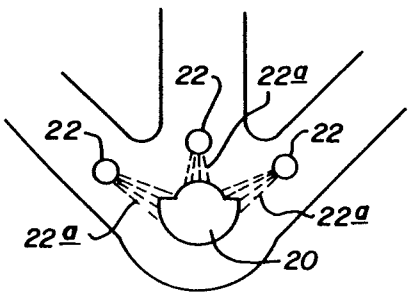
FIG. 2 is a front view showing an enlarged and more detailed view of sprue core 20, shown generally in FIG. 1.

FIG. 2 is a front view of the sprue core 20. Three of the ejector pins 22 are arranged around the sprue core 20. The open ends 22a of the lubricant jetting passageways of the three ejector pins 22 open toward the sprue core 20. These ejector pins 22 are slidable by the ejector plate 30 (see FIG. 1) only when these ejector pins 22 are pushed into the mold cavity. The open ends 22a of the lubricant jetting passageways open toward the sprue core 20.

The mode of operation of this embodiment will now be described. First, as the ejector plate 30 is moved to the right (as shown in FIG. 1), the ejector pin 22 projects into the mold cavity. Then the compressed air flows through air passageway 24 to pump from the lubricant passageway 26 the lubricant stored in the reservoir 28. A mixed gas composed of the compressed air and the lubricant introduction passageway formed in the ejector pin 22. After several die castings (which probably yield unacceptable products), sprue core 20 heats to a sufficiently high temperature to carbonize lubricant sprayed thereon Actually, the lubricant includes oil and a lubricating agent. The oil is vaporized and rises in the mold cavity. The lubricating agent is carbonized and attaches to the outer surface of the sprue core 20.

After the movable mold 12 is moved to the stationary mold 8 to define a mold cavity, carbonize lubricating agent on the sprue core is dried.

Consequently, molten metal is poured into the injection sleeve 14 from the gate 15 thereof. After pouring of the molten metal, the injection plunger 16 is first moved leftwardly in the drawings initially at a low speed. When the molten metal occupies the interior of the injection sleeve 14 over 50%, the injection plunger 16 stops moving forwardly. This stopping of the injection plunger 16 at the intermediate position is detected as the increased diameter portion 16a hits the limit switch 5. The period of time while the injection plunger 16 stops is measured by the intermediate stop position of timer 56, and the valve 38 is switched when the limit switch 5 hits the increased diameter portion 16a so that the negative pressure passageway 48 is caused to communicate with the negative pressure source 36 and the interior of the mold cavity is pumped up into a negative pressure state by the negative pressure source 36. The pump-up timer 58 measures lapsed time after the valve 38 is switched. After this pump-up timer 58 detects a predetermined lapse time has passed, the cut-off pin 46 is moved forwardly by the drive mechanism 60 for the cut-off pin 46 to shut off the intercommunication between the negative pressure passageway 48 and the mold cavity. The cut-off pin 46 is moved forwardly and rearwardly by the drive mechanism 60; its foremost and rearmost positions are detected by the foremost-position limit switch 52 and the rearmost-position limit switch 54, respectively.

After the intermediate stop position timer 56 counts a predetermined stopping period of the injection plunger, the injection plunger 16 is moved forwardly at a high speed so that the molten metal thereby poured into the injection sleeve 14 is sprayed over the mold cavity at a high speed. At that time as the molten metal is sprayed over the mold cavity at a high speed, the carbonized lubricating agent attached to the peripheral surface of the sprue core 20 is brought, together with the molten metal, into the mold cavity. Presumably, the amount of force at which the solidified article is removed or parted from the mold cavity is reduced partly due to the oil of the lubricant vaporized as the lubricant is sprayed over the sprue core 20, and partly due to the carbonized lubricating agent mixed in the molten metal.

After the molten metal is injected into the mold cavity, the molten metal is left for a predetermined lapse time for solidifying the article. After the solidification of the molten metal the movable mold 12 parted away from the stationary mold 8 and then the ejector plate 30 is moved forwardly to eject the solidified article out from the mold cavity. Thus a die-casting has been completed.

Figure 3:
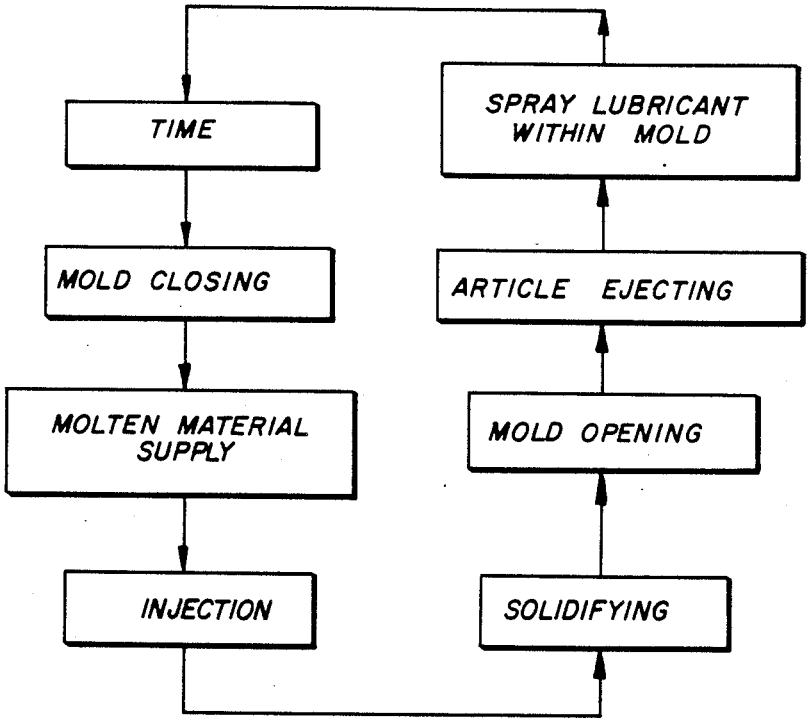
FIGS. 3 and 4 are views illustrating methods, of die-casting according to the invention.

FIG. 3 illustrates a cycle of the above-mentioned die-casting.

In the above-mentioned embodiment, before the movable mold 12 is brought in contact with the stationary mold 8 to define the mold cavity, the ejector pin 22 are moved forwardly to spray the lubricating agent with oil over the sprue core 20. Alternatively, the lubricant may be sprayed over the sprue core 20 after the movable mold 12 is brought into contact with the stationary mold 8.

Figure 4:
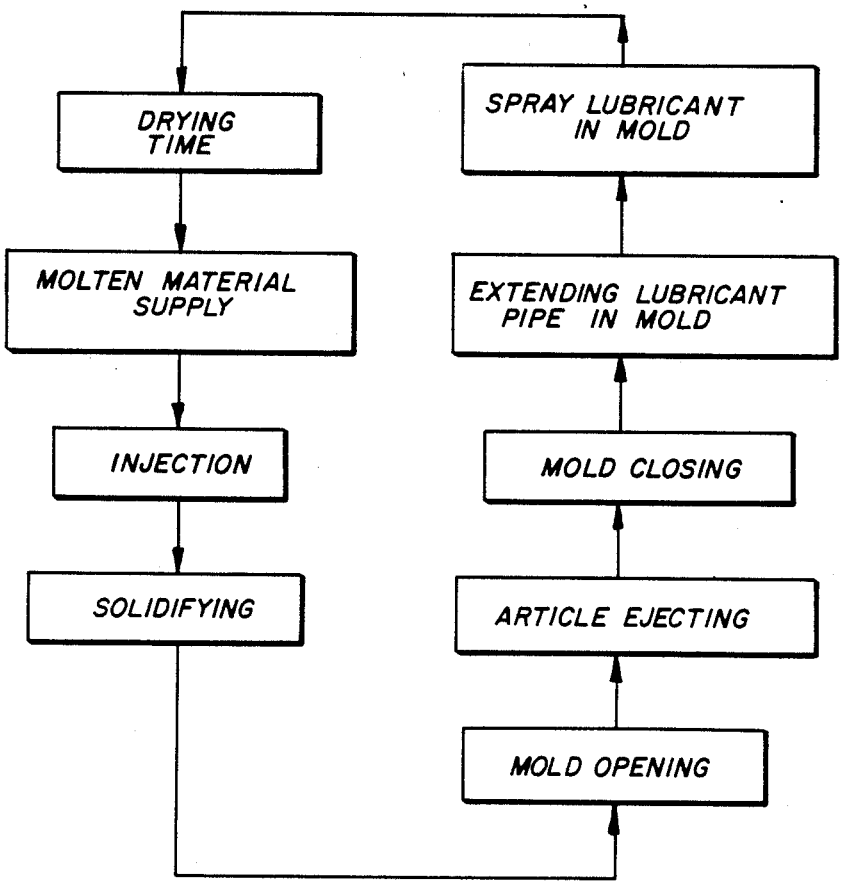

This cycle of the operation is illustrated in FIG. 4.

The particularly noticeable point in the above-mentioned embodiments is that because of the high temperature of the sprue core 20, the lubricating agent will be carbonized as the lubricant is sprayed over the sprue core 20. Accordingly, this carbonized lubricating agent penetrates, together with the molten metal, into the mold cavity, where it is solidified. Even if the carbonized lubricating agent is mixed in the solidified article, it does not occur that this carbonized lubricating agent would expand even when the solidified article is heated lately. This is true because this lubricating agent is already carbonized. Therefore, if the lubricating agent were mixed in gaseous state as conventional, it would have been expanded. Whereas, according to the present invention, such expansion of the lubricating agent can be prevented, thus making the die-cast article free from expansion.

Figure 5:
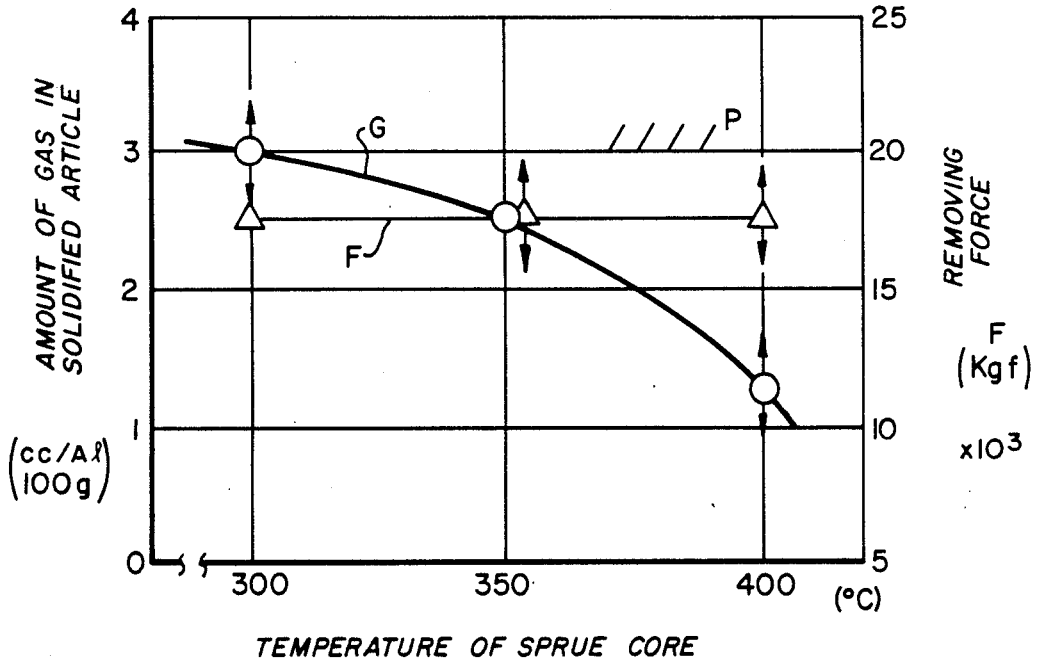
FIG. 5 is a view showing the relation between the temperature of the sprue core, the amount of the gas mixed in the solidified article, and the force required for removing an article formed by die casting according to the invention.

FIG. 5 illustrates the relation between the temperature of the sprue core, the amount of the gas mixed in the solidified article, and the force required for removing the solidified article out from the mold cavity.

Figure 6:
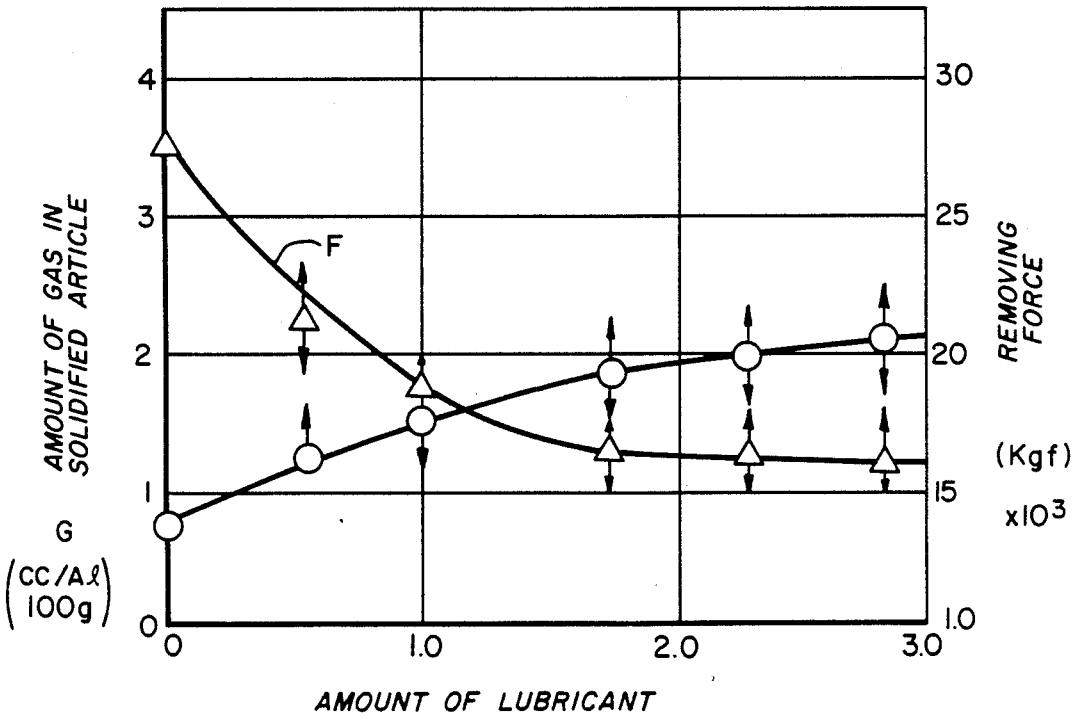
FIG. 6 is a view showing the relation between the amount of lubricant sprayed over the sprue core, the amount of the gas contained in the solidified article, and the force required for removing the article.

FIG. 6 illustrates the relation between the amount of the lubricating agent sprayed over the sprue core 20, the amount of the gas mixed in the die-cast article, and the force required for removing the article out of the mold cavity. As to this embodiment, about 1.7–2.0 cc of lubricant is preferred for one cycle of die casting. According to the present inventor's experience, the amount of 1.8 cc is found to be the most preferable to the die casting. The reason why such amount of 1.2–2.0 cc is preferred in this embodiment is that the removing force F cannot maintain under effective force though the amount of the gas G can be decreased if the amount of the lubricant is less than 1.2 cc and that the removing force F cannot decrease effectively even the lubricant is used more than 2.0 cc. Furthermore, the amount of the gas G which causes bulging to the article increases according with the amount of the lubricant, and also the increase of the amount of the lubricant makes the running cost of the die-casting expensive. The area designated at P in FIG. 5 represents a threshold force required for removing the article out from the mold cavity by the ejector pin 22 without the deformation of the article.

Figure 7:
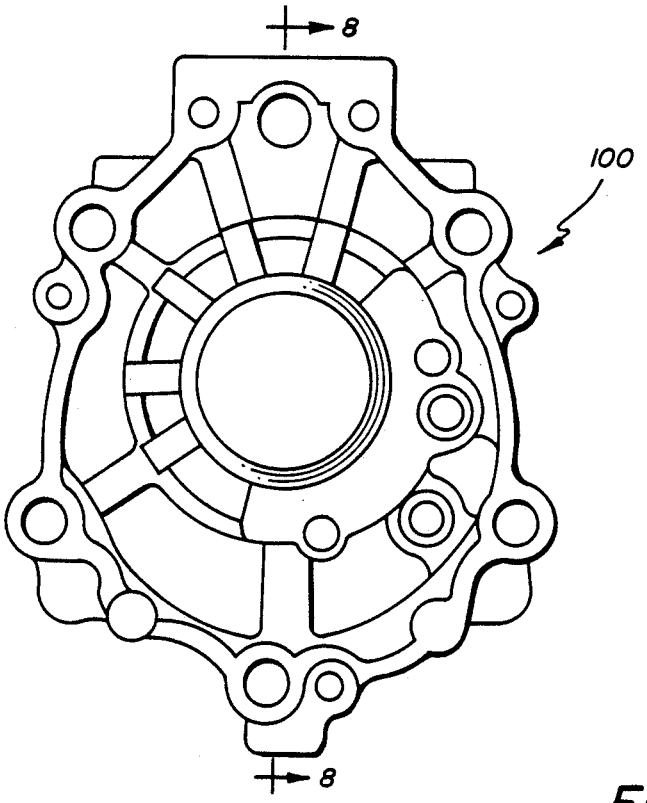
FIG. 7 is a front view of an example of the product.
Figure 8:
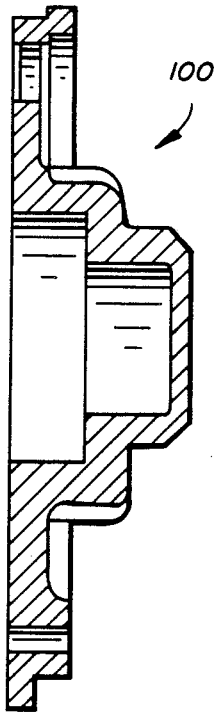
FIG. 8 is a cross-sectional view along the line VIII—VIII in FIG. 7.
Figure 9:
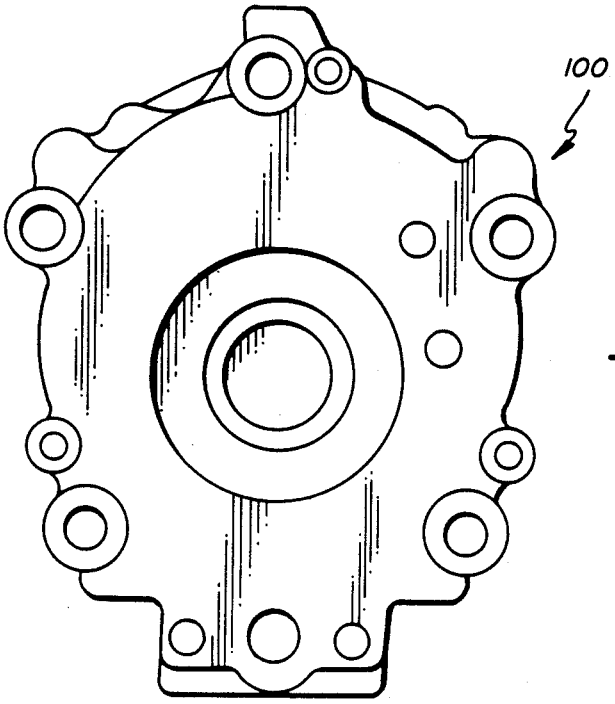
FIG. 9 is a back view of the example.

Using the die-casting method of this embodiment, it is possible to reduce the amount of the gas contained in the article to a value ranging between 1.5 cc/100 gAl and 2.5 cc/100 gAl, compared with the range between 3.5 cc/100 gAl and 7.0 cc/gAl in the conventional die-casting method. And it is possible for the present die-casting to produce the article having a complex structure such as shown in FIGS. 7, 8 and 9.

As explained hereinabove, with the diecasting method of the present invention, since a lubricant is sprayed over a high-temperature portion formed in a sprue interconnecting a mold cavity and an injection sleeve and is partly carbonized, it does not occur that this carbonized lubricating agent would expand even if the carbonized lubricating agent is mixed in a solidified article and the solidified article is heated. Therefore, even if heat is applied to the solidified article (product), it is possible to prevent the product from being bulged and to carry out the heat treatment for hardening of the product easily and effectively.

It is possible to carry out the die-casting method of the present invention satisfactorily by using the die-casting apparatus of the present invention.

Other embodiments and modification of the present invention will be apparent to those of ordinary skill in the art having the benefit of the teaching presented in the foregoing description and drawings. It is therefore, to be understood that this invention is not to be unduly limited and such modifications are intended to be included within the scope of the appended claims.

What is claimed is:

1. A die-casting apparatus comprising:

a stationary mold;

a movable mold contactable with said stationary mold to define therewith a mold cavity and a sprue, a high-temperature portion of said sprue being defined on a surface of one of said stationary mold and said movable mold, said high temperature portion of said sprue including at least a sprue core;

an injection sleeve opening at one end to said mold cavity for introducing molten metal into said mold cavity;

an injection plunger slidably disposed within said injection sleeve for injecting said molten metal into said mold cavity; and a nozzle for spraying a lubricant over said high-temperature portion of said sprue, said nozzle having a spraying path directed towards said surface defining said high-temperature portion of said sprue so that lubricant is sprayed onto said surface.

2. A die-casting apparatus as claimed in claim 1, wherein said high-temperature portion of said sprue is formed on the movable mold.

3. A die-casting apparatus claimed in claim 1, wherein said high-temperature portion of said sprue is at a position confronting said injector sleeve.

4. A die-casting apparatus claimed in claim 1, further comprising an ejector pin for ejecting a solidified metal article from said mold cavity.

5. A die-casting apparatus claimed in claim 4, wherein:

said nozzle is provided on a surface of said ejector pin and a lubricating agent introduction passageway for conducting said lubricant to said nozzle is formed in said ejector pin.

6. A die-casting apparatus claimed in claim 1, wherein:

said nozzle has three openings facing toward said high-temperature portion in such a manner that said three openings surround said high-temperature portion.

7. A die-casting apparatus claimed in claim 1, further comprising a negative pressure passageway formed in said stationary mold for connecting said mold cavity with a negative pressure source.

8. A die-casting apparatus claimed in claim 7, wherein said negative pressure source comprises a vacuum tank, a vacuum pump, and a motor for driving said vacuum pump to form a negative pressure in said tank.

9. A die-casting apparatus claimed in claim 7, wherein said negative pressure passageway includes a valve for switching the negative pressure passageway between a first position in which said mold cavity communicates with said negative pressure source, and a second position in which said mold cavity opens to the atmosphere.

* * * * *